US009622000B2

(12) United States Patent
Horii

(10) Patent No.: US 9,622,000 B2
(45) Date of Patent: Apr. 11, 2017

(54) AUDIO DEVICE

(71) Applicant: KYOCERA CORPORATION, Kyoto (JP)

(72) Inventor: Seiji Horii, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 14/895,970

(22) PCT Filed: Jun. 6, 2014

(86) PCT No.: PCT/JP2014/003045
§ 371 (c)(1),
(2) Date: Dec. 4, 2015

(87) PCT Pub. No.: WO2014/199612
PCT Pub. Date: Dec. 18, 2014

(65) Prior Publication Data

US 2016/0127841 A1 May 5, 2016

(30) Foreign Application Priority Data

Jun. 12, 2013 (JP) ..... 2013-124031

(51) Int. Cl.

| | |
|---|---|
| ***H04R 25/00*** | (2006.01) |
| ***H04R 17/00*** | (2006.01) |
| ***H04R 1/10*** | (2006.01) |
| ***H04R 7/04*** | (2006.01) |
| ***H04R 25/02*** | (2006.01) |

(52) U.S. Cl.
CPC ..... *H04R 25/456* (2013.01); *H04R 1/1016* (2013.01); *H04R 7/045* (2013.01); *H04R 17/005* (2013.01); *H04R 25/02* (2013.01); *H04R 25/606* (2013.01); *H04R 17/00* (2013.01); *H04R 2225/021* (2013.01); *H04R 2460/13* (2013.01)

(58) Field of Classification Search
CPC ... H04R 2460/13; H04R 25/606; H04R 17/00
See application file for complete search history.

(56) References Cited

U.S. PATENT DOCUMENTS

2009/0185699 A1* 7/2009 Kim ..... H04R 1/1066 381/151
2010/0298626 A1* 11/2010 Andersson ..... H04R 17/00 600/25

FOREIGN PATENT DOCUMENTS

JP 2003-264882 A 9/2003
JP 2005-348193 A 12/2005
(Continued)

OTHER PUBLICATIONS

International Search Report, PCT/JP2014/003045 mailed Jul. 8, 2014.

(Continued)

*Primary Examiner* — Matthew Eason
(74) *Attorney, Agent, or Firm* — Studebaker & Brackett PC

(57) ABSTRACT

Provided is an audio device, including: a vibrator 10 that includes a piezoelectric element 101 configured to undergo flexure and a panel 102 configured to be bent directly by the piezoelectric element 101 to vibrate; and a holder 60 that includes a behind-the-ear portion 602 to be hooked over a helix of a user's ear and that holds the vibrator 10 in a position that allows the vibrator 10 to abut against the user's ear, wherein sound is heard by a user.

11 Claims, 4 Drawing Sheets

(56) References Cited

FOREIGN PATENT DOCUMENTS

| | | | |
|---|---|---|---|
| JP | 2006-304147 | A | 11/2006 |
| JP | 2007-165938 | A | 6/2007 |
| JP | 2009-033504 | A | 2/2009 |
| JP | 2011-130334 | A | 6/2011 |
| JP | 2013-078116 | A | 4/2013 |

OTHER PUBLICATIONS

Written Opinion of the International Searching Authority with Concise Explanation, PCT/JP2014/003045, Jul. 8, 2014.

* cited by examiner

AUDIO DEVICE

CROSS-REFERENCE TO RELATED APPLICATION

This application claims priority to and the benefit of Japanese Patent Application No. 2013-124031 filed on Jun. 12, 2013, the entire contents of which are incorporated herein by reference.

TECHNICAL FIELD

The present disclosure relates to an audio device, such as an earphone and a hearing aid, that transmits sound by vibration.

BACKGROUND

Audio devices, including a conventional open fit hearing aid, are provided with a vent to let an inside of an external auditory canal communicate with the outside to reduce the sense of muffling when these devices are worn (Refer to Patent Literature 1, for example.) A conventional hearing aid includes a microphone, an earphone, and a vent. The microphone collects sound from a sound source, and the earphone enables a user to hear the sound collected by the microphone. The vent, as described above, is a hole that lets the inside of the external auditory canal communicate with the outside. The vent prevents occlusion of the external auditory canal, and accordingly, the user feels reduced sense of muffling when wearing the hearing aid.

CITATION LIST

Patent Literature

PTL 1: JP2006304147A

SUMMARY

Technical Problem

In a conventional open fit hearing aid, sound emitted in the earphone travels through the external auditory canal down to the eardrum (Path I). Some of the sound emitted from the earphone, mainly low-pitched sound, leaks out of the vent to the outside (Path II). In addition to the sound from the earphone, sound from the sound source passes through the vent and reaches to the eardrum directly (Path III). Leakage of low-pitched sound out of the vent of the hearing aid leads to a decrease in sound pressure of a low-pitched sound, and the sensation of loudness is jeopardized. On the other hand, although one possible way to prevent leakage of low-pitched sounds is to reduce a diameter of the vent, this evokes the sense of muffling and jeopardizes comfort during the time the hearing aid is worn.

The present disclosure has been conceived in view of the above problem, and the present disclosure is to provide an audio device that hardly jeopardizes the sensation of loudness and comfort.

Solution to Problem

One of aspects of the present disclosure resides in an audio device including: a vibrator that includes a piezoelectric element configured to undergo flexure and a panel configured to be bent directly by the piezoelectric element to vibrate; and a holder that includes a behind-the-ear portion and that holds the vibrator in a position that allows the vibrator to abut against the user's ear, wherein sound is heard by a user.

Advantageous Effect

The audio device of the present disclosure does not greatly jeopardize the sensation of loudness and comfort, despite the fact that these two are contradictory.

DETAILED DESCRIPTION

In the following, embodiments of the present disclosure are described.

Embodiment

Figure 1:
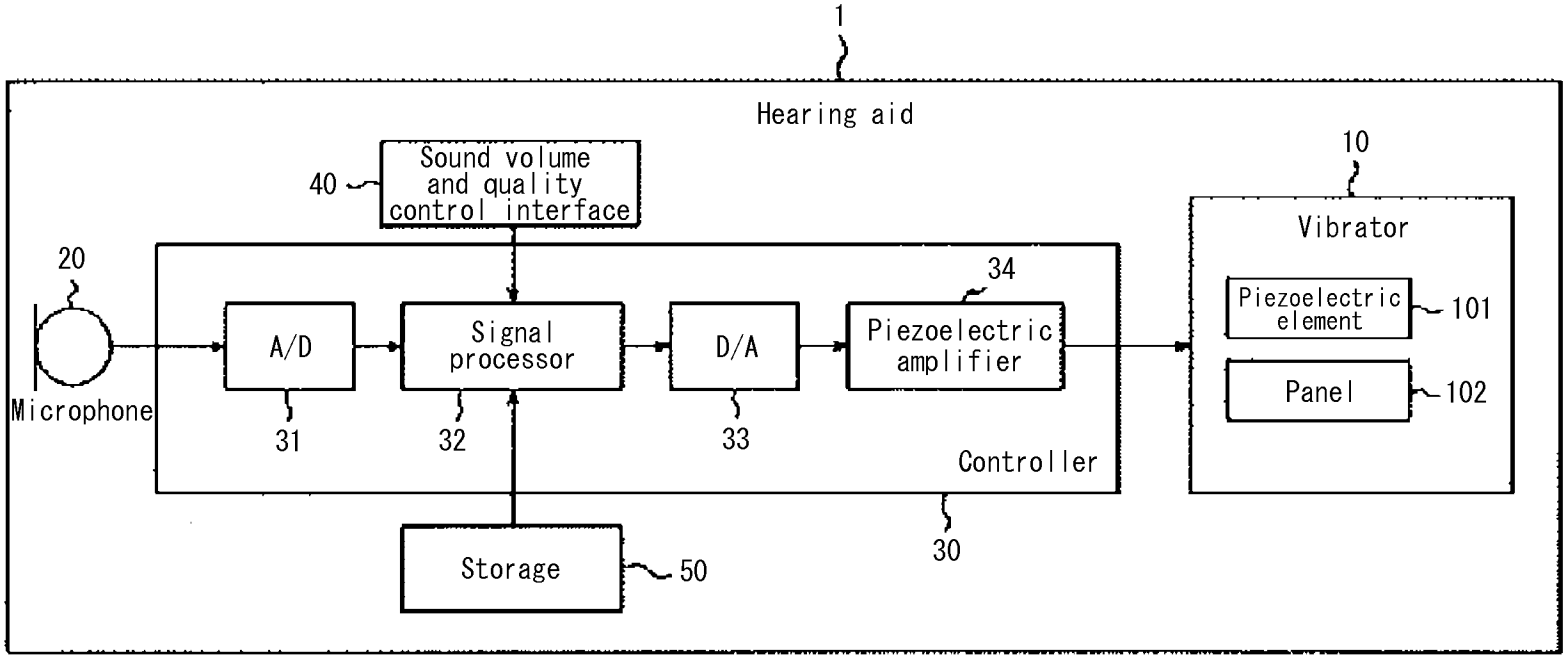
FIG. 1 is a block diagram of a hearing aid according to one of embodiments of the present disclosure.
Figure 3:
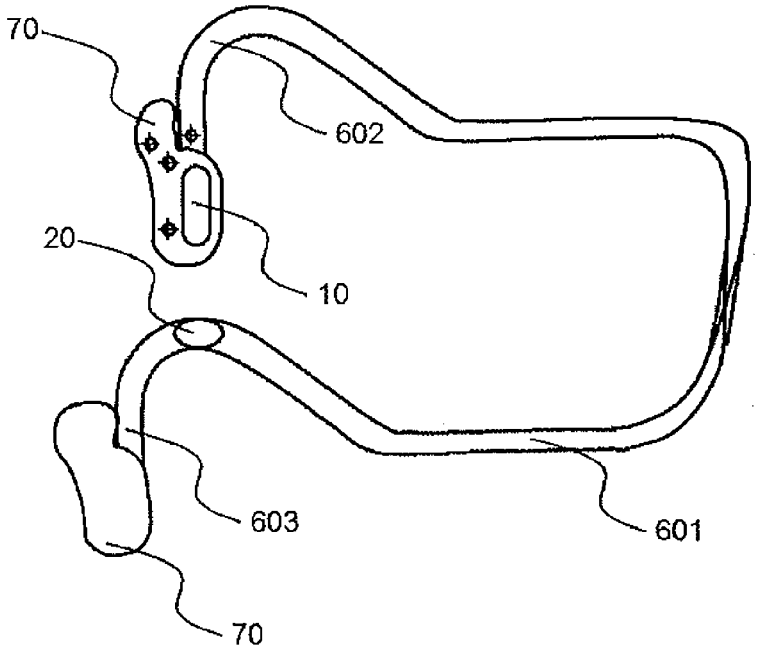
FIG. 3 is an appearance view of a hearing aid according to one of embodiments of the present disclosure.

FIG. 1 is a block diagram of an audio device (e.g., a hearing aid) according to one of embodiments of the present disclosure. The audio device illustrated in FIGS. 1 and 3 is, for example, a hearing aid 1. The audio device includes vibrators 10, microphones 20, a controller (IC) 30, a sound volume and quality control interface 40, a storage 50, a holder 60, and housings 70.

Figure 2:
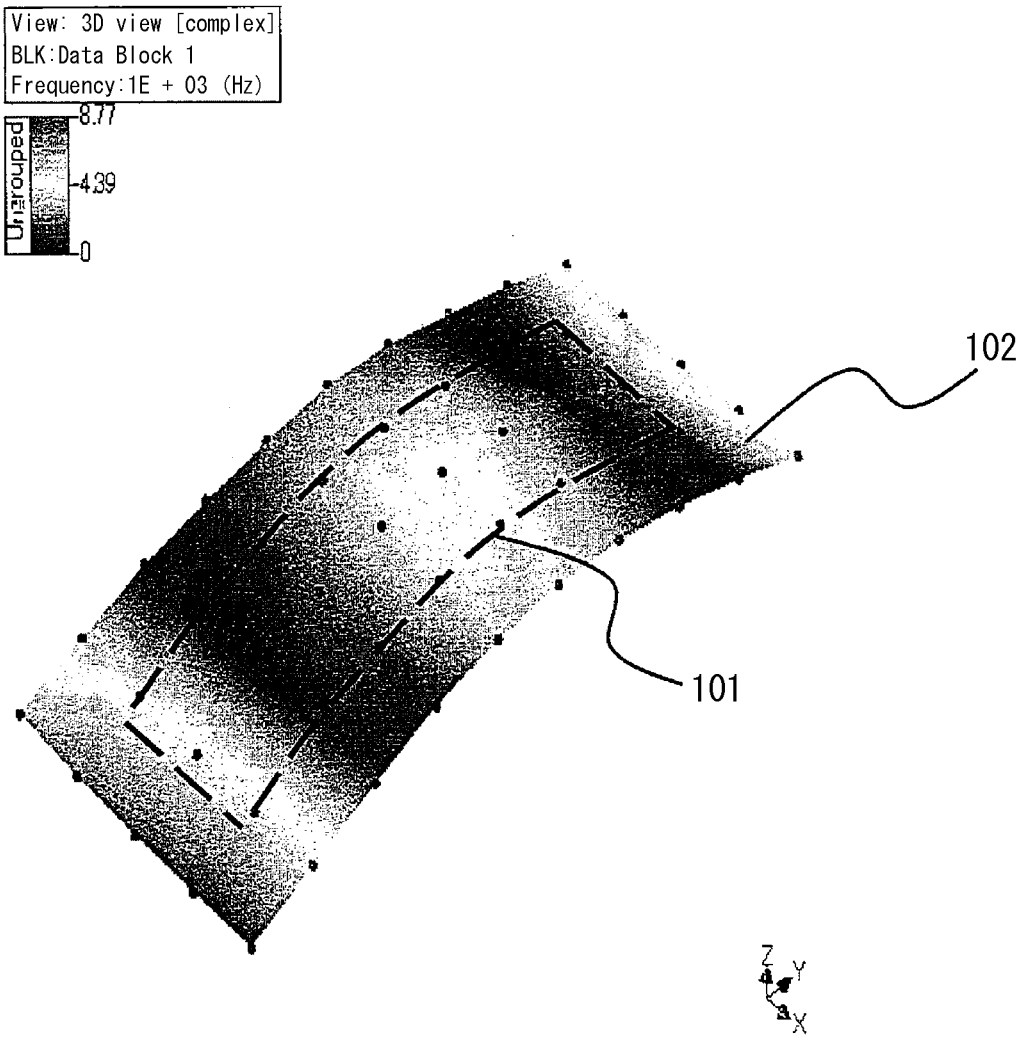
FIG. 2 is a schematic view of flexure of a panel and a piezoelectric element included in a hearing aid according to one of embodiments of the present disclosure.

Each vibrator 10 includes a piezoelectric element 101 configured to undergo flexure and a panel 102 configured to be bent directly by the piezoelectric element 101 to vibrate. FIG. 2 schematically illustrates a state where the piezoelectric element 101 causes the panel 102 to undergo flexure. Since being bent directly by the piezoelectric element 101 to vibrate, the panel 102 is bent in a manner such that a portion of the panel 102 that is located around the middle of the panel 102 protrudes relative to both end portions of the panel. The vibrator 10 enables a user to hear air conduction sound and human-body vibration sound, which is transferred by the vibration, in frequency bands including a low frequency range (1 kHz or less). Air conduction sound is sound perceived by an auditory nerve of the user as a result of an eardrum being vibrated by an air vibration that is created by a vibration of an object and that travels through an external auditory canal down to the eardrum. Human body vibration sound is transferred to the auditory nerve of the user through a part of a user's body (e.g., a cartilaginous portion of an external ear) that is in contact with the vibrating object.

The piezoelectric element 101 is an element that is configured to undergo expansion and contraction or bending (flexure) in accordance with an electromechanical coupling factor of a constituent material in response to an electric signal (voltage) applied thereto. As a material of the element, for example, ceramic and crystal are used. The piezoelectric element 101 may be a unimorph, a bimorph, or a laminated-type piezoelectric element. The laminated-type piezoelectric element includes a laminated-type unimorph element in which (e.g., 16 or 48 layers of) unimorph are laminated or a laminated-type bimorph element in which (e.g., 16 or 48 layers of) bimorph are laminated. The laminated-type piezoelectric element is configured, for example, by a laminated structure of a plurality of dielectric layers made of lead zirconate titanate (PZT) and electrode layers each disposed between adjacent ones of the dielectric layers. Unimorph undergoes expansion and contraction in response to an electric signal (voltage) applied thereto, and bimorph undergoes bending in response to an electric signal (voltage) applied thereto.

The panel 102 may be made of glass or a synthetic resin such as acryl. The panel 102 preferably has a plate shape, and the description below assumes the panel 102 to have a plate shape.

Each microphone 20 is configured to collect sound from a sound source, for example, sound reaching the vicinity of a helix of a user's ear. Accordingly, the microphone 20 is less likely to pick up sound blocked by the helix and leaking out of the external auditory canal (i.e., less likely to create a howling sound) and easily reproduces sound to be heard by the user naturally.

The controller (IC) 30 performs various control with respect to the hearing aid 1. The control unit 30 applies, to the piezoelectric element 10, a predetermined electric signal (voltage corresponding to a sound signal). In detail, in the controller 30, an analog-digital converter 31 converts a sound signal of the sound collected by the microphone 20 to a digital signal. Then, a signal processor 32 outputs the digital signal for actuating the vibrator 10 based on information regarding sound volume and quality acquired from the sound volume and quality control interface 40 and on information stored in the storage 50. A digital-analog converter 33 converts the digital signal to an analog signal, and a piezoelectric amplifier 34 amplifies the analog signal and applies the electric signal to the piezoelectric element 101. The voltage that the controller 30 applies to the piezoelectric element 101 may be greater than a voltage to be applied, for example, to an air conduction earphone speaker configured for sound conduction using air conduction sound. With the above configuration, the piezoelectric element 101 causes vibration of the panel 102, and human-body vibration sound which is transferred through a part of the user's body is generated. Note that an amount of the application voltage is appropriately adjustable according to how tightly the panel 102 is fixed or according to a capability of the piezoelectric element 101. When the control unit 30 applies an electric signal to the piezoelectric element 101, the piezoelectric element 101 undergoes expansion and contraction or flexture in the longitudinal direction.

At this time, the panel 102 attached with the piezoelectric element 101 is deformed in conjunction with expansion and contraction or flexture of the piezoelectric element 101, thus resulting in the vibration of the panel 102. The panel 102 undergoes flexure due to expansion and contraction or flexture of the piezoelectric element 101. The panel 102 is bent directly by the piezoelectric element 101. The state in which the "panel 102 is bent directly by the piezoelectric element 101" differs from a phenomenon in which the panel 102 is deformed when a certain area of the panel 102 is vibrated due to inertial force of a piezoelectric actuator including the piezoelectric element 101 provided in a casing as adopted in an existing panel speaker. The state in which the "panel 102 is bent directly by the piezoelectric element 101" refers to a state in which the panel 102 is bent directly by expansion and contraction or bending (flexure) of the piezoelectric element 101 via a joining member.

Since the panel 102 vibrates as described above, the panel 102 generates air conduction sound, and the panel 102 also generates human-body vibration sound in the frequency bands including a low frequency range (1 kHz or less) that is transferred through a tragus, when the user places the tragus in contact with the panel 102. Preferably, the vibration of the panel 102 has nodes located around both ends of the panel 102 and a loop located in the middle of the panel 102, and the middle of the panel 102 and a periphery thereof abut against the tragus and the antitragus. The above configuration allows the vibration of the panel 102 to be transferred to the tragus and the antitragus efficiently.

FIG. 3 is a schematic diagram of the hearing aid 1 according to one of embodiments of the present disclosure. As illustrated in FIG. 3, the holder 60 holds, in each of ends thereof, the housing 70. The housings 70 support the vibrators 10 in positions opposite to the ears.

The holder 60 presses each vibrator 10 to the corresponding ear. The vibrator 10 may abut against, among other positions, the tragus, the antitragus, or the auricular concha of the user's ear. The description of the present embodiment below describes an example where the vibrator 10 abuts against the tragus (an inner wall of the external auditory canal located on the side of the tragus) of the user's ear.

The holder 60 includes an arm portion 601 that wraps around the back of the user's head. The arm portion 601 may be designed to adjust pressure load to be in the range approximately from 0.1 N to 10 N when the housing 70 abuts against, for example, the tragus of the ear. The arm portion 601, which has an appropriate degree of elasticity, may be manufactured, for example, by coating a metallic spring having a predetermined curved shape with resin or by using a resin spring.

Figure 5:
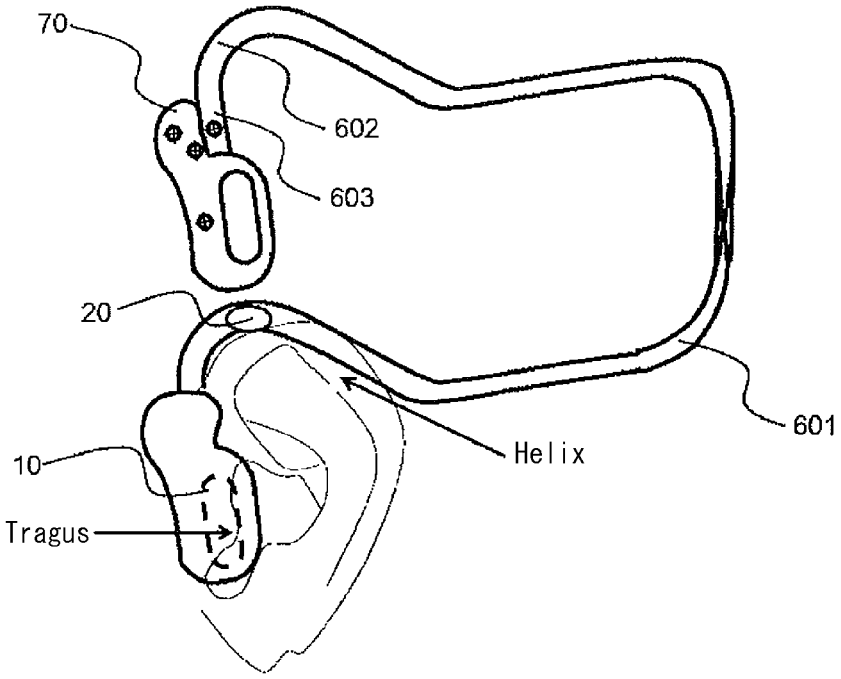
FIG. 5 illustrates a state in which the hearing aid of FIG. 3 is worn on the ear of a user.

The holder 60 includes a pair of behind-the-ear portions 602 that is contiguous with the arm portion 601. As illustrated in FIG. 5, each behind-the-ear portion 602 is curved to be hooked on a part of the user's helix. The behind-the-ear portions 602 may be manufactured integrally with the arm portion 601.

Each behind-the-ear portion 602 of the holder 60 is equipped with the microphone 20. Although two microphones 20 are preferably provided for both the ears, a single microphone may also be provided on the left or right. The microphone 20 inputs a signal to the controller 30 which is later described, through a signal line (which is not illustrated) disposed in the holder 60 (the behind-the-ear portions 602 and supporting portions 603).

The holder 60 includes the supporting portions 603 located on tips of the behind-the-ear portions 602 to support the housings 70. The holder 60 holds each housing 70 in a manner such that the vibrator 10, which is disposed opposite to the housing 70, abuts against the user's ear.

The housing 70 is supported by the corresponding supporting portion 603 of the holder 60, and the housing 70 includes, inside thereof, a substrate 702 and so forth. The following describes the housing 70 and the vibrator 10 in detail with reference to an example of FIG. 4.

Figure 4:
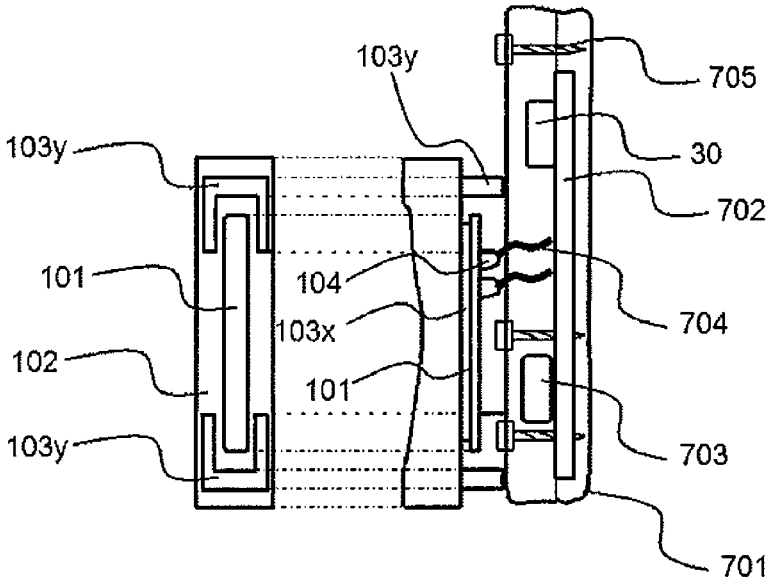
FIG. 4 is a sectional view of a vibrator and a housing in the thickness direction and also is a bottom view of the vibrator.

FIG. 4 is a sectional view of the vibrator 10 and the housing 70 as viewed in the thickness direction. As described earlier, the vibrator 10 includes the piezoelectric element 101 and the panel 102. As illustrated in FIG. 4, the piezoelectric element 101 preferably has a plate shape.

The piezoelectric element 101 is joined to the panel 102 by a joining member 103*x*. The joining member 103*x* is disposed between a main surface of the piezoelectric element 101 and a main surface of the panel 102. The joining member 103*x* may be an adhesive agent that is not thermosetting, or a double-sided adhesive tape. For example, a double-sided adhesive tape containing fabric impregnated with an adhesive resin may be used.

Preferably, the main surface of the panel 102 has an area that is from 0.8 to 10 times an area of the main surface of the piezoelectric element 101. The main surface of the panel 102, which has the area in the range from 0.8 to 10 times the area of the main surface of the piezoelectric element 101, is allowed to deform in conjunction with expansion and contraction or bending of the piezoelectric element 101 and also provides a sufficient contact area with the user's ear. Preferably, the area of the panel may be from 0.8 to 5 times the area of the piezoelectric element.

The main surface of the panel 102 that is positioned on the side of the ear may have a concave shape. This shape makes it easier for the panel 102 to contact the protruding tragus than cases where the main surface has a flat plate shape. That is to say, the concave panel 102 is effective to address misalignment.

On a back surface side (opposing to the housing 70) of the panel 102, a pair of double-sided adhesive tapes 103*y* is disposed. The double-sided adhesive tapes 103*y* adhere the panel 102 to the main surface of the housing 70. Thus, the panel 102 is adhered to the housing 70. The double-sided adhesive tapes 103*y* are each disposed on a different one of both end sides of the piezoelectric element 101. Since the double-sided adhesive tapes 103*y* are not disposed on other areas, such as a middle portion, than both the end sides of the piezoelectric element 101, easy vibration with low power consumption is ensured in the middle portion or the like. Additionally, when the piezoelectric element 101 is powerful enough, the panel 102 may also includes the double-sided adhesive tape 103*y* which adheres all the areas of the panel 102 to the housing 70.

Each double-sided adhesive tape 103*y* may have a U-shape surrounding three sides of the corresponding end portion of the piezoelectric element 101. In this case, the small area of the panel 102 is effectively utilized, and adhesive strength is reinforced without difficulty.

On a back surface side (opposing to the housing body) of the piezoelectric element 101, a pair of solder joints 104 is formed, and a wire 704 is joined to connect to a substrate 702 disposed in the housing 70 which is later described.

The housing 70 includes a case 701, the substrate 702, a battery 703, the wire 704, and a screw 705 and also contains the controller (IC) 30.

The case 701 is made of, for example, plastic. For example, the case 701 is obtained by molding a resin material, such as polycarbonate resin and amine-based resin. The case 701 may also be formed by interleaved glass fiber. The case 701 only needs to have a minimum weight that does not pose a burden to the helix and be strong enough to bear impact caused by dropping or the like. On the other hand, the case 701, if too light and thin, will easily resonate and cause energy loss, and therefore, the material and weight of the case 701 may be determined in consideration of both the factors.

The case 701 includes two sub-members screwed into a single case by the screw 705. When the battery 703 is not rechargeable, the two sub-members had better not be adhered but be screwed for battery exchange.

The substrate 702 disposed in the case 701 is electrically connected to the controller 30 and the piezoelectric element 101 through the solder joints 104 and the wire 704. The substrate also contains the battery 703.

FIG. 5 illustrates a state in which the hearing aid 1 is worn on the ear of a user, according to one of embodiments of the present disclosure. The hearing aid 1 of the present embodiment enables the user to hear sound by the vibrator 10 abutting against the vicinity of the tragus and the antitragus of the user's ear from the outer side of the ear to transfer the vibration to the vicinity of the tragus and the antitragus. In the example of FIG. 5, the vibrator 10 of the hearing aid 1 is in abutment against the tragus of the user's ear from the outer side of the ear. Of course, the vibrator 10 of the hearing aid 1 may be pressed against a single ear. The vibrator 10 of the hearing aid 1 may also be pressed against both the left and right ears. In the illustrated state, the external auditory canal is not sealed by the vibrator 10 and the housing 70. Accordingly, the hearing aid 1 of the present disclosure does not evoke the sense of muffling and supports comfort during the time the hearing aid 1 is worn.

Preferably, the vibrator 10 may be pressed against the user's ear with force ranging from 0.1 N to 3 N. Even when the vibrator 10 is pressed with force ranging from 0.1 N to 3 N, vibration of the vibrator 10 is transferred to the ear satisfactorily. The pressing force of 3 N or less also allows the user to wear the hearing aid 1 for a long time period without feeling little sense of fatigue, thus supporting comfort during the time the hearing aid 1 is worn. Furthermore, even when the tragus is more or less flattened, this does not lead to sealing of the external auditory canal, and the sense of muffling is less likely to arise.

Figure 6:
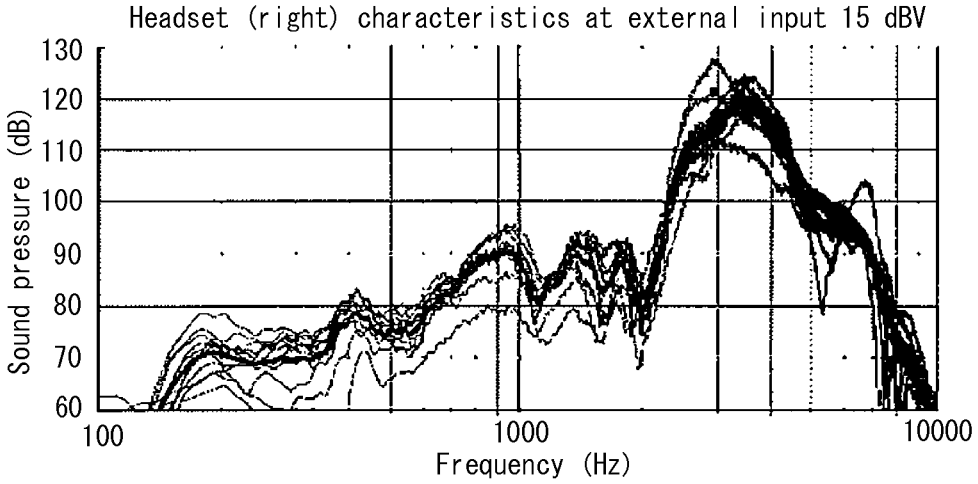
FIG. 6 illustrates actual measurements of acoustic characteristics of a hearing aid according to one of embodiments of the present disclosure.

Next, a description is given of acoustic characteristics of the hearing aid 1 according to one of embodiments of the present disclosure with respect to FIG. 6. FIG. 6 illustrates actual measurements of frequency characteristics of the vibrator 10 located on the right side of the hearing aid 1 of the present disclosure. The measurements of 12 samples and average values thereof are illustrated. The figure indicates that the hearing aid 1 provides a satisfactory hearing aid function in frequency bands in the range from 200 Hz to 8 kHz with respect to an external input of 15 dBV. Especially, the hearing aid 1 achieves high sound pressure even in frequency bands in the range from 3 kHz to 4 kHz and may be effective for use by hearing-impaired people who use a language, such as English, other than Japanese. Alternatively, the hearing aid 1 is also preferred for use as an earphone because the hearing aid 1 is adapted for broad frequency bandwidths. Additionally, the hearing aid 1 of FIG. 6 employs a low-pass filter that attenuates a signal gradually toward 8 kHz.

When the low-pass filter is not used, the hearing aid 1 may cause the piezoelectric element 101 to vibrate even with respect to ultrasonic frequency bands, such as 40 kHz. The hearing aid 1 may be used as an audio device that generates various ultrasonic waves.

As has been described, the hearing aid 1 of the present disclosure enables the user to hear sound through vibration of the vibrator 10 and accordingly, secures sound pressure in the frequency bands including a low frequency range by using human-body vibration sound. Consequently, the sensation of loudness is not jeopardized. The hearing aid 1 does not need to include a vent that prevents leakage of low-pitched sounds and accordingly, prevents the problem of jeopardizing comfort during the time the hearing aid 1 is worn.

Although the present embodiment is described based on an example where the audio device is the hearing aid 1, the present embodiment is not limited to this example. For example, the audio device may also be a head phone or an earphone, and in this case, the microphone 20 may be omitted. Furthermore, in this case, sound reproduced by the audio device may be based on music data stored in an internal memory of the audio device or based on music data stored in an external server and the like transmitted over the network.

Although in the present embodiment is described based on an example where the vibrator 10 is brought into abutment against the tragus of the user's ear from the outer side of the ear to transfer the vibration to the tragus to enable the user to hear sound, the present embodiment is not limited to this example. For example, the vibrator 10 may be brought into abutment against the antitragus of the user's ear from the outer side of the ear to transfer the vibration to the antitragus to enable the user to hear sound. Furthermore, the vibrator 10 may be brought into abutment against the tragus and the antitragus of the user's ear from an inner side of the ear to transfer the vibration to the tragus and the antitragus to enable the user to hear sound.

Although the present disclosure has been described based on the drawings and the embodiments, it is to be noted that a person skilled in the art may easily make various changes and modifications according to the present disclosure. Therefore, such changes and modifications are to be understood as included within the scope of the present disclosure. For example, functions and the like included in various means, members, and so forth may be rendered in any logically consistent way. Furthermore, means and members may be combined into one or divided.

An electronic device and a unit disclosed herein are described as having various functional parts configured to execute preferable functions. Note that the functional parts are merely illustrated schematically for simplification of description of the functionality and do not necessarily represent specific hardware or software. In this sense, any hardware or software that practically executes the preferable functions described herein may be implemented as the functional parts and other components. Various functions of different components may be achieved by any hardware and software used in combination or alone, and these may be adopted separately or in combination of two or more. Thus, various aspects of the present disclosure may be implemented in many different embodiments without departing from the scope of the present disclosure.

REFERENCE SIGNS LIST

1 audio device (hearing aid)
10 vibrator
101 piezoelectric element
102 panel
103 double-sided adhesive tape
104 solder joint
20 microphone
30 controller (IC)
31 analog-digital converter
32 signal processor
33 digital-analog converter
34 piezoelectric amplifier
40 sound volume and quality control interface
50 storage
60 holder
601 arm portion
602 behind-the-ear portion
603 supporting portion
70 housing
701 case
702 substrate
703 battery
704 wire
705 screw

The invention claimed is:

1. An audio device, comprising:
a vibrator that includes a piezoelectric element configured to undergo flexure and a panel configured to be bent directly by the piezoelectric element to vibrate; and
a holder that includes a behind-the-ear portion to be hooked over a helix of a user's ear and that holds the vibrator in a position that allows the vibrator to abut against the user's ear, wherein
sound is heard by a user,
the vibrator is configured to abut against a tragus of the user's ear from an outer side of the ear to transfer the vibration to the tragus to enable the user to hear sound,
the vibration of the panel has a loop located in a middle of the panel and nodes located on both sides of the loop, and
the middle of the panel and a periphery thereof abut against the tragus.

2. An audio device, comprising:
a vibrator that includes a piezoelectric element configured to undergo flexure and a panel configured to be bent directly by the piezoelectric element to vibrate; and
a holder that includes a behind-the-ear portion to be hooked over a helix of a user's ear and that holds the vibrator in a position that allows the vibrator to abut against the user's ear, wherein
sound is heard by a user,
the vibrator is configured to abut against an antitragus of the user's ear from an outer side of the ear to transfer the vibration to the antitragus to enable the user to hear sound,
the vibration of the panel has a loop located in a middle of the panel and nodes located on both sides of the loop, and
the middle of the panel and a periphery thereof abut against the antitragus.

3. The audio device of claim 1, wherein
the holder has elasticity and presses the vibrator in the position that allows the vibrator to abut against the user's ear.

4. The audio device of claim 1, wherein
the vibrator is disposed on both ends of the holder in correspondence with user's left and right ears.

5. The audio device of claim 1, wherein
the audio device does not seal an external auditory canal of the user's ear.

6. An audio device, comprising:
a vibrator that includes a piezoelectric element configured to undergo flexure and a panel configured to be bent directly by the piezoelectric element to vibrate; and
a holder that includes a behind-the-ear portion to be hooked over a helix of a user's ear and that holds the vibrator in a position that allows the vibrator to abut against the user's ear, wherein
sound is heard by a user, the vibrator is configured to abut against a tragus of the user's ear from an inner side of the ear to transfer the vibration to the tragus to enable the user to hear sound, the vibration of the panel has a loop located in a middle of the panel and nodes located on both sides of the loop, and the middle of the panel and a periphery thereof abut against the tragus.

7. An audio device, comprising:

a vibrator that includes a piezoelectric element configured to undergo flexure and a panel configured to be bent directly by the piezoelectric element to vibrate; and a holder that includes a behind-the-ear portion to be hooked over a helix of a user's ear and that holds the vibrator in a position that allows the vibrator to abut against the user's ear, wherein sound is heard by a user, the vibrator is configured to abut against an antitragus of the user's ear from an inner side of the ear to transfer the vibration to the antitragus to enable the user to hear sound, the vibration of the panel has a loop located in a middle of the panel and nodes located on both sides of the loop, and the middle of the panel and a periphery thereof abut against the antitragus.

8. The audio device of claim 1, further comprising:

a microphone.

9. The audio device of claim 1, wherein the vibrator generates sound radiated into an external auditory canal of the user's ear through air conduction.

10. The audio device of claim 1, wherein the vibrator is pressed against the user's ear with force ranging from 0.1 N to 3 N.

11. The audio device of claim 1, wherein the piezoelectric element has a plate shape, and the panel has an area that is from 0.8 to 10 times an area of a main surface of the piezoelectric element.

* * * * *